US010736410B2

(12) United States Patent
Kaicker

(10) Patent No.: US 10,736,410 B2
(45) Date of Patent: Aug. 11, 2020

(54) COSMETIC BRUSH FIBER HAVING TRIANGULAR CROSS SECTION

(71) Applicant: ANISA INTERNATIONAL, INC., Atlanta, GA (US)

(72) Inventor: Anisa Telwar Kaicker, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 427 days.

(21) Appl. No.: 15/457,501

(22) Filed: Mar. 13, 2017

(65) Prior Publication Data

US 2017/0265637 A1 Sep. 21, 2017

Related U.S. Application Data

(60) Provisional application No. 62/308,852, filed on Mar. 15, 2016.

(51) Int. Cl.

| | |
|---|---|
| ***A46B 9/02*** | (2006.01) |
| ***A45D 40/26*** | (2006.01) |
| ***A46D 1/00*** | (2006.01) |
| ***A46D 1/05*** | (2006.01) |
| ***A46D 1/055*** | (2006.01) |

(52) U.S. Cl.

CPC ..... *A46B 9/021* (2013.01); *A45D 40/262* (2013.01); *A46B 9/028* (2013.01); *A46D 1/0207* (2013.01); *A46D 1/0238* (2013.01); *A46D 1/0276* (2013.01); *A46D 1/05* (2013.01); *A46D 1/055* (2013.01); *A46B 2200/1046* (2013.01)

(58) Field of Classification Search

CPC . A46B 9/021; A46B 9/028; A46B 2200/1046; A45D 40/262; A46D 1/0238

See application file for complete search history.

(56) References Cited

U.S. PATENT DOCUMENTS

| | | | | |
|---|---|---|---|---|
| 2,317,485 | A * | 4/1943 | Rider | A46D 1/00 15/167.1 |
| 5,238,011 | A * | 8/1993 | Gueret | A46B 3/18 132/218 |
| 5,567,072 | A * | 10/1996 | Dunleavy | A45D 34/045 132/218 |
| 6,367,114 | B1 | 4/2002 | Babkowski | |
| 7,752,702 | B2 | 7/2010 | Nakamura | |
| 2008/0073968 | A1 | 3/2008 | Shiina | |
| 2012/0301210 | A1 | 11/2012 | Sturgis | |

(Continued)

FOREIGN PATENT DOCUMENTS

| | | |
|---|---|---|
| KR | 10-1024089 B1 | 3/2011 |
| WO | 2017160807 | 9/2017 |

OTHER PUBLICATIONS

Kaicker, Anisa Telwar; International Preliminary Report on Patentability for PCT Application No. PCT/US17/22261, filed Mar. 14, 2017, dated Sep. 27, 2018, 10 pgs.

(Continued)

*Primary Examiner* — Randall E Chin

(74) *Attorney, Agent, or Firm* — Taylor English Duma LLP

(57) ABSTRACT

Disclosed is a new fiber which has a triangular cross section, and which may be used as a substitute for animal hair with comparable pickup and other properties. The disclosure also relates to methods for providing same.

10 Claims, 5 Drawing Sheets

(56) References Cited

U.S. PATENT DOCUMENTS

| | | | | |
|---|---|---|---|---|
| 2013/0291326 | A1* | 11/2013 | Mintel | A46B 9/04 15/167.1 |
| 2013/0312207 | A1 | 11/2013 | Lim | |
| 2019/0014896 | A1 | 1/2019 | Kaicker | |
| 2020/0154875 | A1 | 5/2020 | Kaicker et al. | |

OTHER PUBLICATIONS

International Searching Authority, ISR and Written Opinion for International Appn No. PCT/US2017022261, dated Mar. 15, 2017, 12 pages, KIPO, Republic of Korea.

Kaicker, Anisa Telwar; Requirement for Restriction/Election for U.S. Appl. No. 16/135,421, filed Sep. 19, 2018, dated May 1, 2020, 8 pgs.

* cited by examiner

COSMETIC BRUSH FIBER HAVING TRIANGULAR CROSS SECTION

CROSS-REFERENCE TO RELATED APPLICATIONS

The present application claims all benefit and priority to U.S. Provisional Patent Application No. 62308852, filed 2016 Mar. 15, and fully incorporates the contents of said application and its entire file history.

BACKGROUND

Technical Field

This disclosure relates to fibers (aka bristles) such as used in cosmetic brushes or the like.

BRIEF SUMMARY

The present disclosure relates to a new fiber which has a triangular cross section, and which may be used as a substitute for animal hair with comparable pickup and other properties. The disclosure also relates to methods for providing same.

Generally described, the disclosure relates to a cosmetic brush, including a plurality of elongate brush bristles each having a triangular transverse cross section, such that each of said elongate brush bristles defines three substantially parallel edges along the length of each of said the bristles.

Another aspect of the present disclosure may include the cosmetic brush as noted above, wherein each of said plurality of elongate brush bristles includes a free end configured for the application of cosmetics, each of said free ends having a short tip.

Another aspect of the present disclosure may include the cosmetic brush as noted above, further comprising a plurality of elongate brush bristles each having a circular transverse cross section, said plurality of elongate brush bristles each having a circular transverse cross section being intermixed with said plurality of elongate brush bristles each having a triangular transverse cross section.

Another aspect of the present disclosure may include the cosmetic brush as noted above, wherein each of said plurality of elongate brush bristles having a triangular transverse cross section includes a triangular transverse cross section which defines an equiangular triangle.

Another aspect of the present disclosure may include the cosmetic brush as noted above, wherein each of said plurality of elongate brush bristles having a triangular transverse cross section includes a triangular transverse cross section which defines an equiangular triangle having sides each having a length being greater than or equal to 0.05 mm and less than or equal to 0.1 mm.

Another aspect of the present disclosure may include the cosmetic brush as noted above, wherein each of said plurality of elongate brush bristles having a triangular transverse cross section includes a wave.

Another aspect of the present disclosure may include the cosmetic brush as noted above, wherein each of said plurality of elongate brush bristles having a triangular transverse cross section is composed of extruded Polybutylene Terephthal ate.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along the length of each of said the bristles; and B) combining said plurality of said bristles to provide a brush head for application of cosmetics.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein each of said plurality of elongate brush bristles having a triangular transverse cross section is made of extruded Polybutylene Terephthalate.

Another aspect of the present disclosure may include the method as noted above, wherein each of said plurality of elongate brush bristles having a triangular transverse cross section is provided with a short tip by dipping one of its tips in a solution including sodium hydroxide.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along the length of each of said the bristles; B) soaking said plurality of elongate brush bristles each having a triangular transverse cross section in water; C) dipping one of the tips of each said plurality of elongate brush bristles of step B in a solution including sodium hydroxide so as to provide a short tip; and D) combining said plurality of said bristles to provide a brush head for application of cosmetics, such that said short tips are commonly oriented and free.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein in step "B", said plurality of elongate brush bristles are soaked in water for 10 minutes at room temperature.

Other aspects and advantages of the present disclosure will become obvious to the reader and it is intended that these objects and advantages are within the scope of the present invention.

ELEMENT LIST

Here is a list of the various elements:

10 Brush Assembly
20 Bristles
21 Exemplary Bristle
22 Quadrangular Bristle
30 Ferrule
40 Handle
100 Extrusion plate
102 Extrusion holes

DETAILED DESCRIPTION AND BEST MODE OF IMPLEMENTATION

The present disclosure now will be described more fully hereinafter with reference to the accompanying drawings, in which some, but not all embodiments of the disclosure are shown. The invention may be embodied in many different forms and should not be construed as limited to the embodiments set forth herein; rather, these embodiments are provided so that this disclosure will satisfy applicable legal requirements. Like numbers refer to like elements throughout.

Reference is now made to the figures, in which like elements indicate like elements throughout the several views.

General Operating Environment

Figure 1:
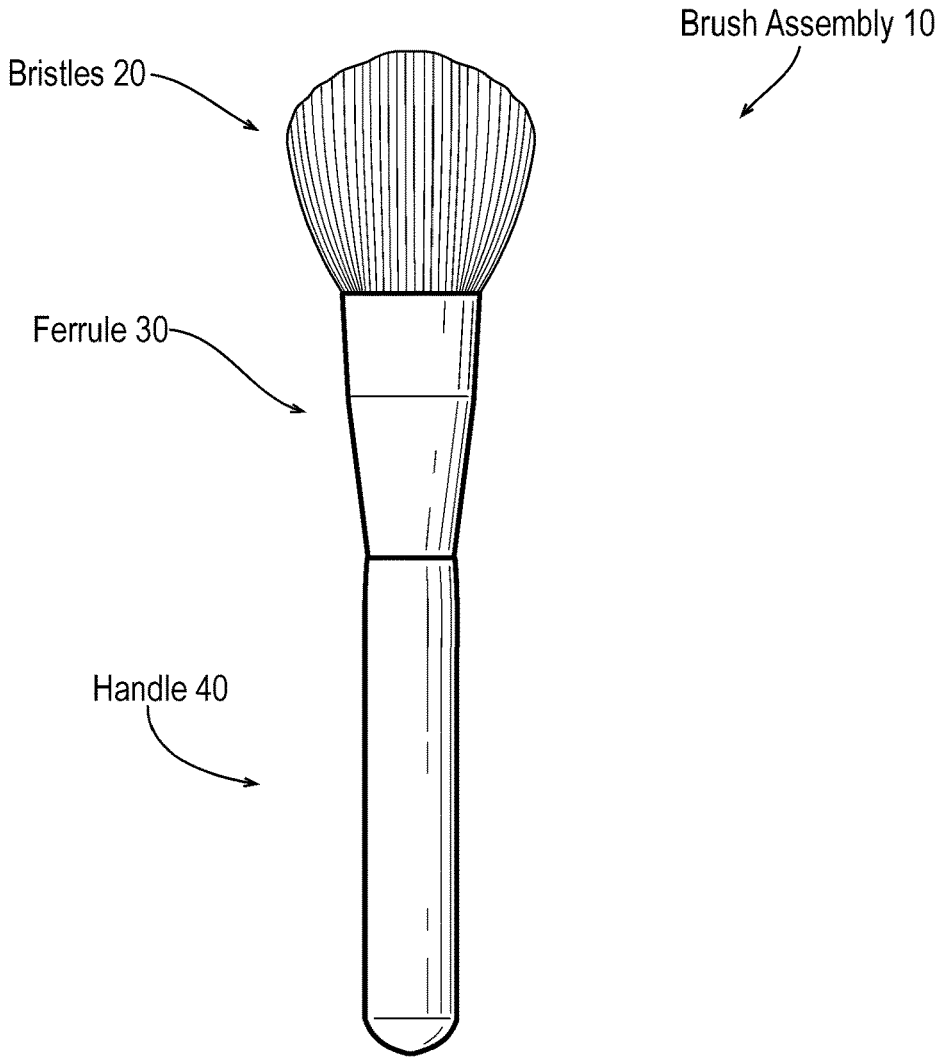
FIG. 1 illustrates an example brush assembly 10, including bristles 20, a ferrule 30, and a handle 40. The bristles 20 include multiple individual elongate bristle elements discussed in more detail later. The ferrule 30 attaches the bristles 20 relative to the handle 40, such that a user (not shown) can grasp the handle 40 and apply cosmetic product to the bristles 20, and thereafter from the bristles 20 to the user's face (not shown).

As will be seen, discussion will be made herein regarding bristles for use in cosmetic brushes of the like, said bristles having a triangular cross section. Reference is made to FIG. 1, which illustrates an example brush assembly 10, including bristles 20, a ferrule 30, and a handle 40. The bristles 20 include multiple individual elongate bristle elements. The ferrule 30 attaches the bristles 20 relative to the handle 40, such that a user (not shown) can grasp the handle 40 and apply cosmetic product to the bristles 20, and thereafter from the bristles 20 to the user's face (not shown).

The Triangular Fiber (Aka Triangular Bristle)

Figure 2:
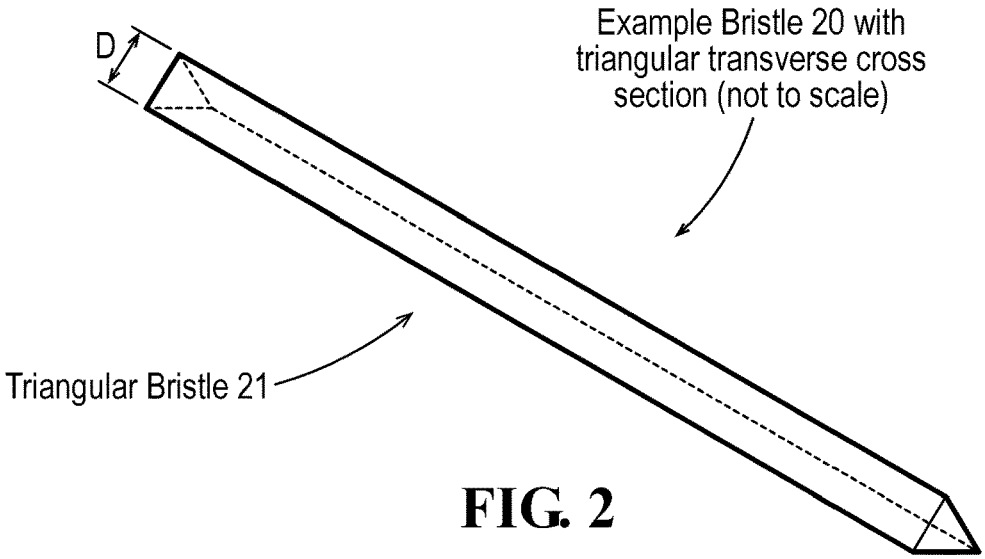
FIG. 2 illustrates an example bristle 20 (aka fiber 20) with a triangular transverse cross section. This figure is not to scale. In this embodiment the triangular transverse cross section is that of an equiangular triangle. it should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.
Figure 3:
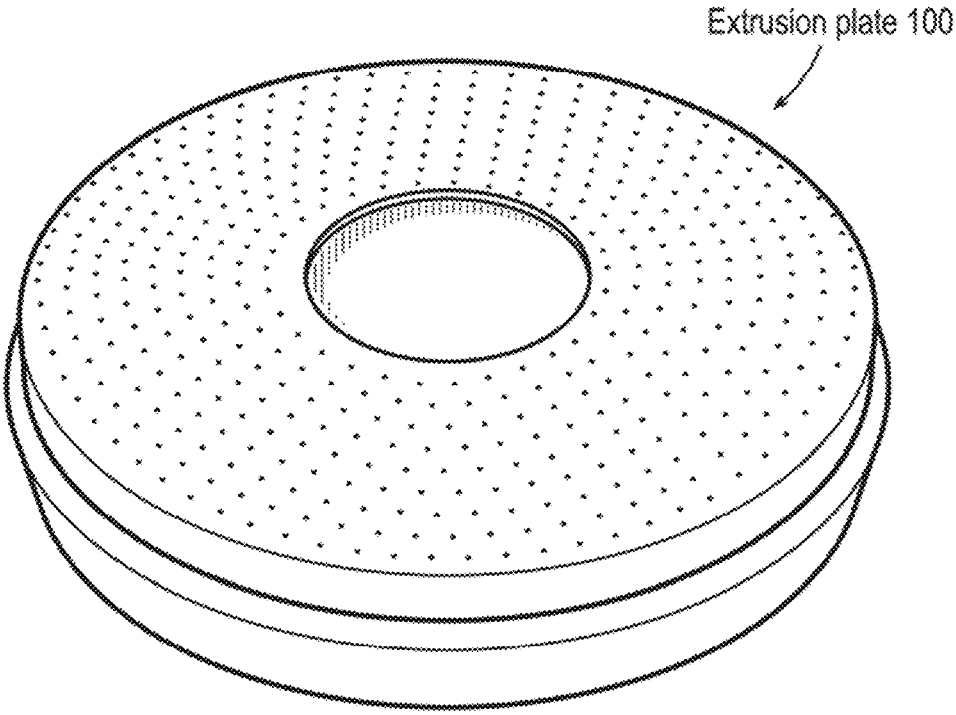
FIG. 3 illustrates an extrusion plate 100.
Figure 4:
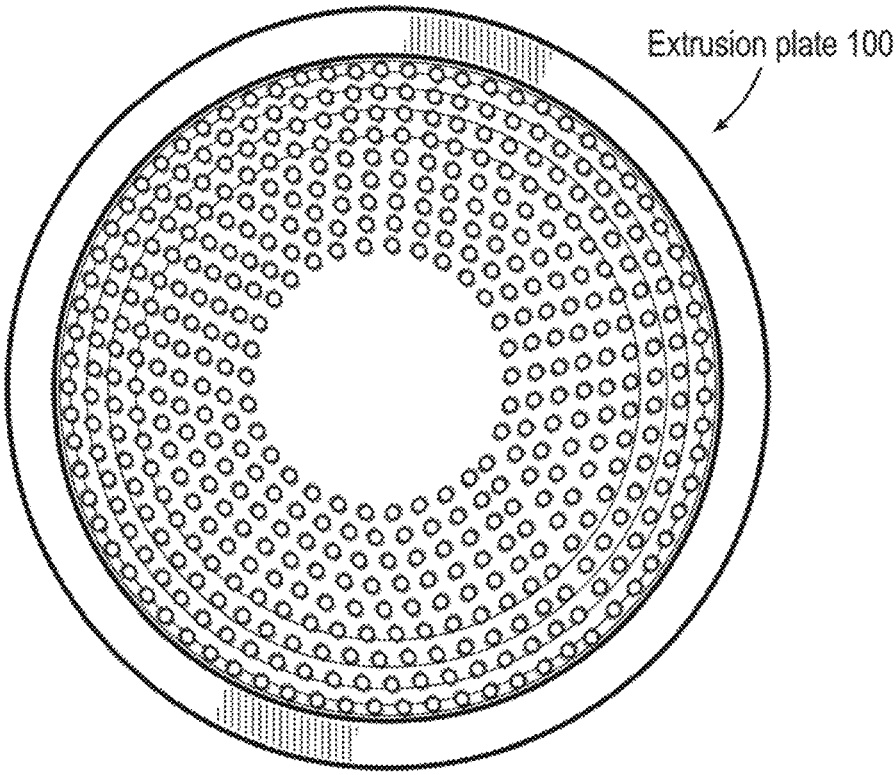
FIG. 4 illustrates the inlet side of the extrusion plate 100.
Figure 5:
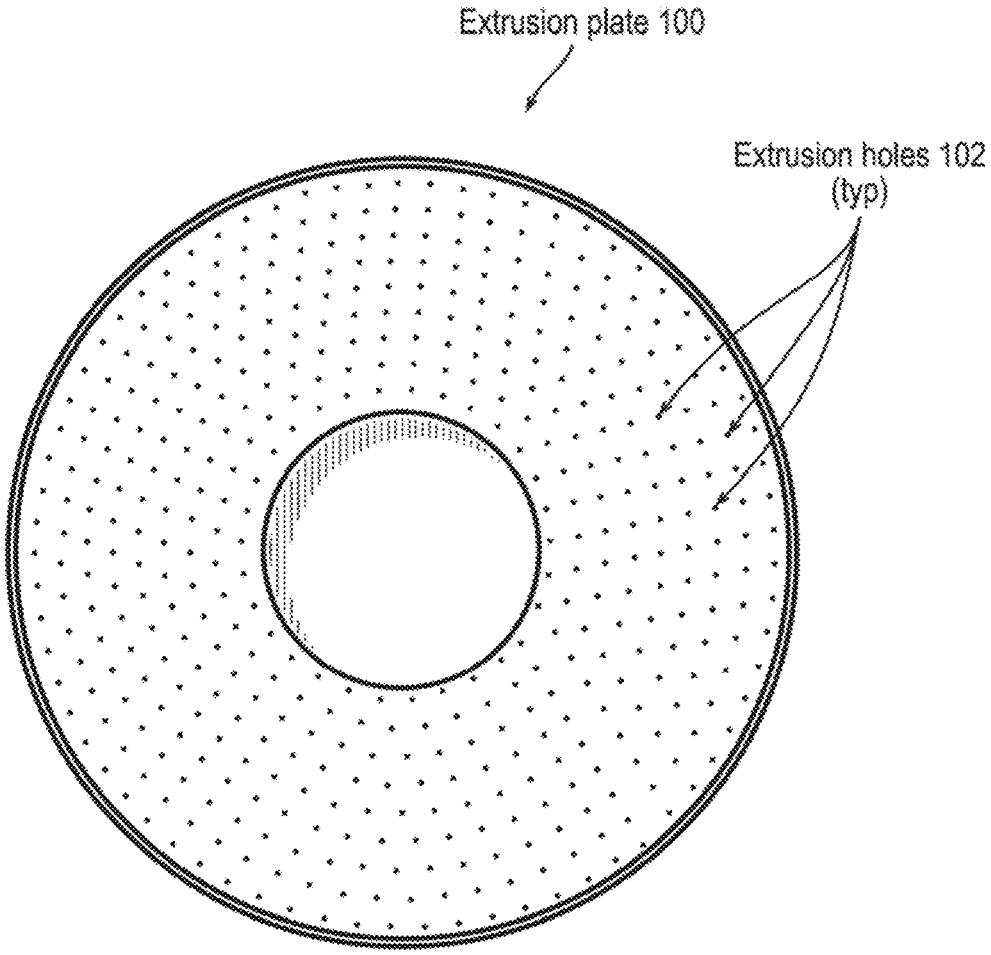
FIG. 5 illustrates the outlet side of the extrusion plate 100, which includes a plurality of extrusion holes 102.
Figure 6:
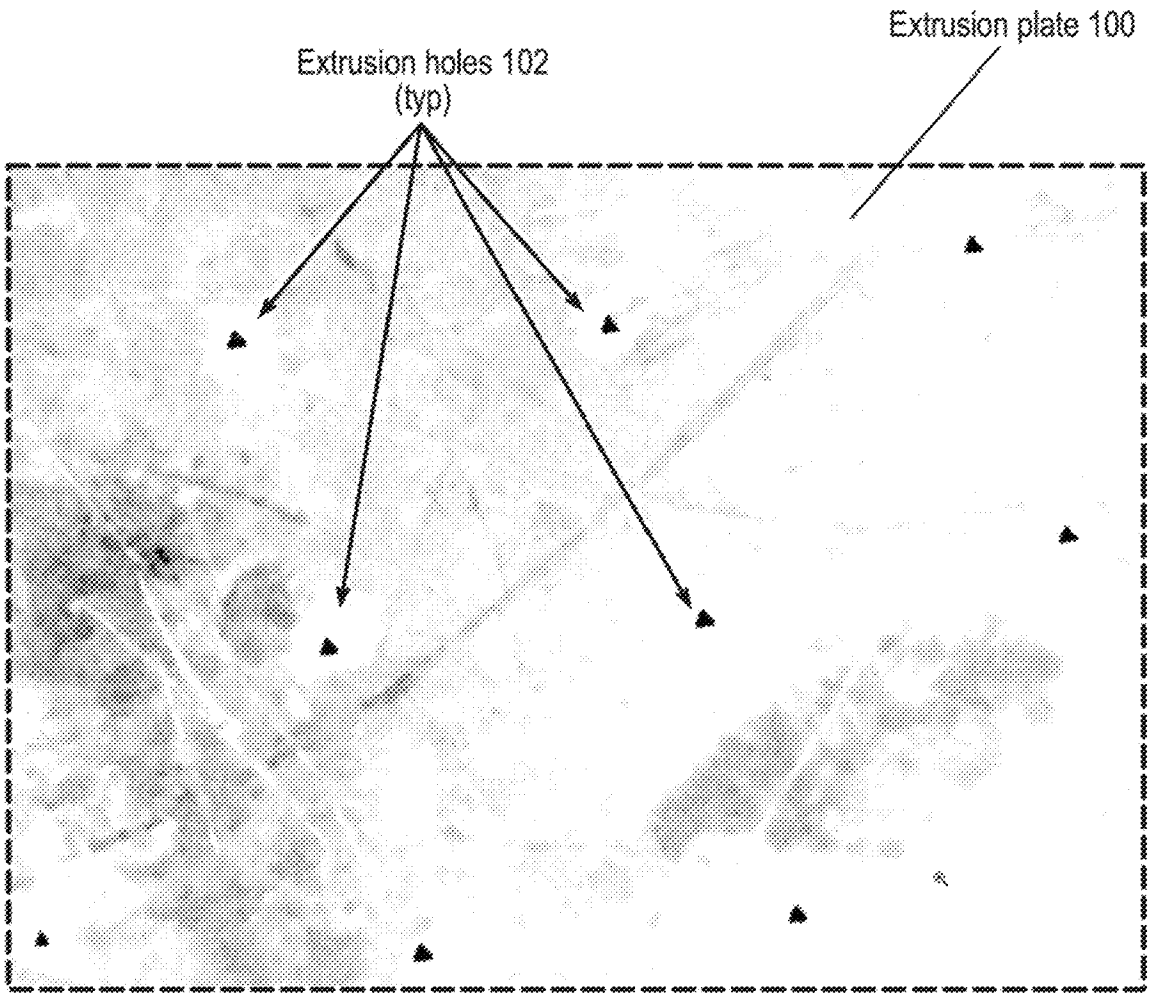
FIG. 6 is a close up partial view of that shown in FIG. 5, illustrating the extrusion holes 102 on the outlet side of the extrusion plate 100.

Reference is now made to FIG. 2, which illustrates an example triangular bristle 21 (aka triangular fiber 21) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.

Uses of the Triangular Bristles

Contemplated herein is the use of a triangular bristle such as 21 in a cosmetic brush such as brush assembly 10 in FIG. 1, to apply cosmetic products to the skin.

Mixture with Other Bristles

Under one configuration, the triangular section fibers 21 may be used alone, that is, no other types of bristles may be used in the bristles 20.

Under another configuration the triangular section fibers 21 may be used in a blend of fibers which might contain a percentage of triangular section fibers and a percentage of circular transverse section PBT fibers (such as are commonly used for makeup brushes).

Advantages of the Triangular Bristles

The cosmetic industry is getting more and more involved in environmentally friendly manufacture/products and animal cruelty issues.

For this reason, the inventors contemplate making brushes with PBT, instead of animal hair. The challenge of doing so is that the animal hair provides more powder pick up compared to conventional PBT, because the animal hair has a texture on the surface in part due to the presence of cuticles. Extruded PBT does not have such a surface texture.

The triangular bristles increase the powder pick up power of the brush, because the shape of each bristle (three parallel edges along the length of the bristle) is capable of scratching the surface of the press powder product (the triangular fiber shape "scratches" more compared to a circular section fiber).

Said another way, the triangular fiber can be used for animal hair substitution because of its ability of picking up powder better than the commonly used circular section PBT.

Dimensions of the Triangular Bristles

Reference is again made to FIG. 2, which illustrates an example bristle 20 (aka fiber 20) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20.

The sizes of the dimension D is contemplated to include the following lengths: 0.05 mm, 0.06 mm, 0.07 mm, 0.08 mm 0.09 mm, and 0.1 mm. Another way of saying this is that the triangular transverse cross sections which define an equiangular triangle have sides each having a transverse measured length being greater than or equal to 0.05 mm and less than or equal to 0.1 mm. Each of these sizes would provide different advantages.

Composition of Fibers

The composition of the fibers is in one configuration to be PBT (Polybutylene Terepthalate).

However, other materials and better resins are contemplated.

Some cosmetic filaments are made with Nylon, although the elasticity and retention of the material is not as good as PBT.

DuPont has two cosmetic filaments named Sorona and Natrafil. The two are not PBT and they could be extruded in a triangular section.

Extrusion of Fibers

The manufacture of the fibers is done by PBT extrusion techniques such as known in the art, such as using a triangular plate tooling to archive the triangular PBT section of the fiber.

A "wave" can be provided in the fiber and is achieved with a conventional crimping method.

The Tipping Process as Applied to Round Bristles

Disclosed is the use of a NaOH solution used to dip the tips of the hair into to eat away at the tips which gives the fiber a softer feel on the face. This may be understood as providing a "short" tip to the fiber/bristle.

In one embodiment of the present disclosure, a chemical tipping process is used to provide similar short tips to the synthetic fiber. Here is a description of the "short tip" tipping process for the following two types of PBT fibers having round cross sections:

0.05 mm diameter, 40 mm long 0.07 mm diameter, 40 mm long

Hair Dimension 0.05 mm Diameter, 40 mm Long

Figure 7:
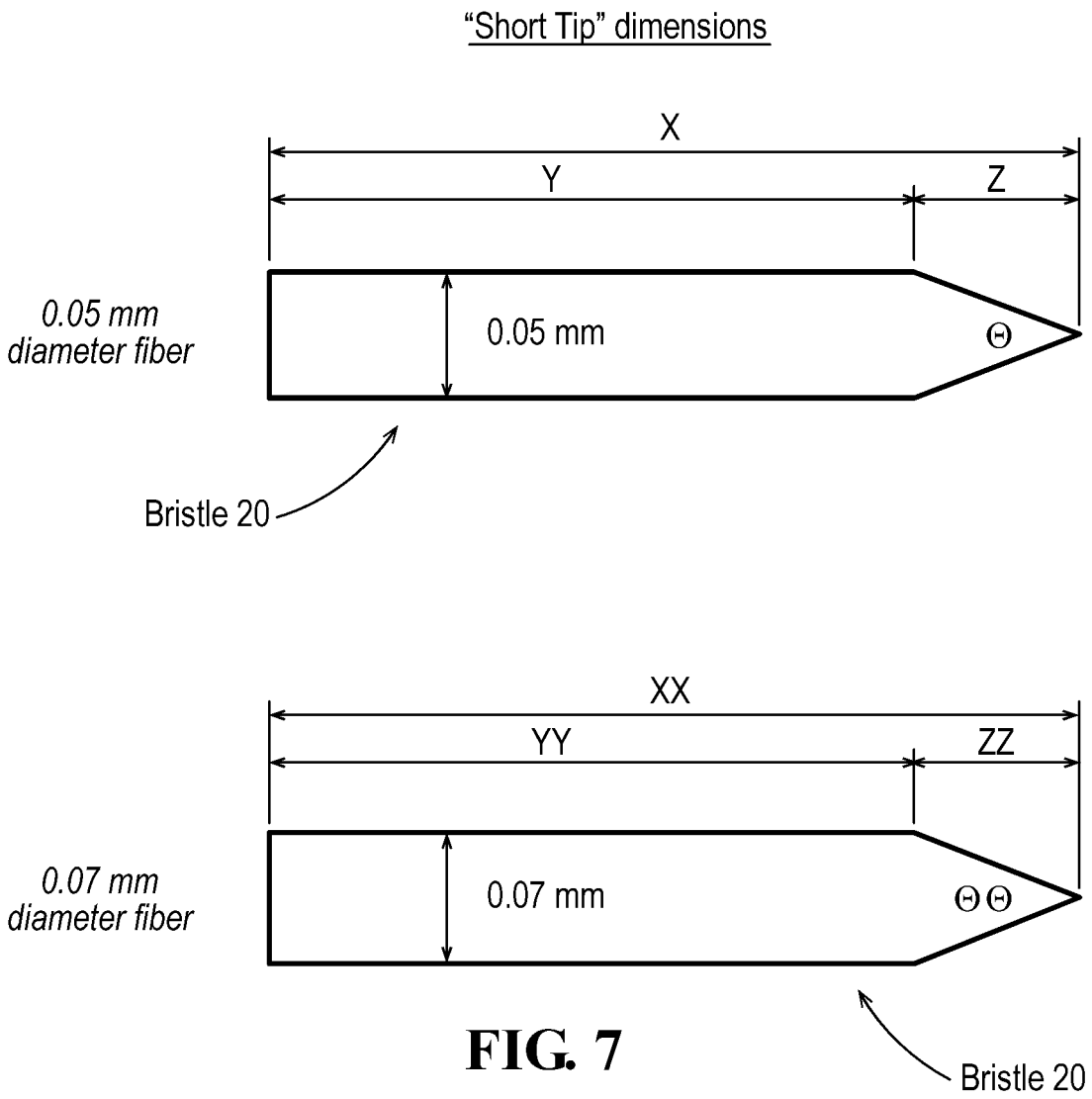
FIG. 7 shows various "short" tip dimensions for PBT round cross section fibers/bristles.

Reference is made to FIG. 7. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 135'C+/−2 degrees C.

Time: 17 min+/−1 min

Length tip is dipped into solution: 5 mm~6 mm+/−1 mm

Final tip length: 1 mm+/−0.2 mm

The process is as follows. A PBT fiber having a dimension of 0.06 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 135'C+/−2. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the Z dimension in FIG. 7.

Hair Dimension 0.07 mm Diameter, 40 mm Long

Reference is made to FIG. 7. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+1-2 percent

Temperature: 132'C+/−2 degrees C.

Time: 17 min+/−1 min

Length tip is dipped into solution: 5 mm~6 mm+/−1 mm

Final tip length: 1 mm+/−0.2 mm

The process is as follows. A PBT fiber having a dimension of 0.075 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 132 degrees C.+/−2 degrees. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the ZZ dimension in FIG. 7.

The Tipping Process as Applied to Triangular Bristles

As noted above NaOH is a solution used to dip the tips of the round bristles into to eat away at the tips which gives the fiber a softer feel on the face.

For the triangular bristles, it's a little different.

A normal PBT fiber bundle (with circular cross sections) is dense, while the triangular fiber bundle is less dense, due to the shape of the fiber.

With less density, the fibers more easily soak with and absorb the NaOH solution. So there is a need to better control the process to avoid the triangular fiber bundle absorbing too much NaOH solution. This is done by soaking the material in water before it is "tipped".

The bundle is soaked in water for 10 minutes at room temperature. Otherwise the tipping process for the round bristles is used.

CONCLUSION

Various modifications and variations can be made in the present invention without departing from the spirit or scope of the invention.

What is claimed is:

1. A cosmetic brush, including a plurality of elongate brush bristles each having a triangular transverse cross section, such that each of said elongate brush bristles defines three substantially parallel edges along the length of each of said the bristles, wherein each of said plurality of elongate brush bristles includes a free end configured for the application of cosmetics, each of said free ends having a short tip tapering away from the elongate brush bristle, each of said short tips defining a length of between about 0.8 mm and 1.2 mm.

2. The cosmetic brush as claimed in claim 1, further comprising a plurality of elongate brush bristles each having a circular transverse cross section, said plurality of elongate brush bristles each having a circular transverse cross section being intermixed with said plurality of elongate brush bristles each having a triangular transverse cross section.

3. The cosmetic brush as claimed in claim 1, wherein each of said plurality of elongate brush bristles having a triangular transverse cross section includes a triangular transverse cross section which defines an equiangular triangle.

4. The cosmetic brush as claimed in claim 1, wherein each of said plurality of elongate brush bristles having a triangular transverse cross section includes a triangular transverse cross section which defines an equiangular triangle having sides each having a length being greater than or equal to 0.05 mm and less than or equal to 0.1 mm.

5. The cosmetic brush as claimed in claim 1, wherein each of said plurality of elongate brush bristles having a triangular transverse cross section includes a wave.

6. The cosmetic brush as claimed in claim 1, wherein each of said plurality of elongate brush bristles having a triangular transverse cross section is composed of extruded Polybutylene Terephthalate.

7. The cosmetic brush as claimed in claim 1, wherein each of said plurality of elongate brush bristles defines a length of about 40 mm.

8. The cosmetic brush as claimed in claim 1, wherein each of said short tips is formed by dipping said free ends in a solution.

9. The cosmetic brush as claimed in claim 8, wherein said solution comprises sodium hydroxide.

10. The cosmetic brush as claimed in claim 8, wherein said plurality of elongate brush bristles are soaked in water prior to dipping said free ends in said solution.

* * * * *